United States Patent [19]

Beeker et al.

[11] 4,406,227

[45] Sep. 27, 1983

[54] SYSTEM FOR MULTISTAGE, AERIAL DISSEMINATION AND RAPID DISPERSION OF PRESELECTED SUBSTANCES

[75] Inventors: Charles W. Beeker, Baltimore; Arthur P. Dean, Glen Arm; William G. Rouse, Aberdeen, all of Md.

[73] Assignee: The United States of America as represented by the Secretary of the Army, Washington, D.C.

[21] Appl. No.: 252,632

[22] Filed: Apr. 9, 1981

[51] Int. Cl.[3] ..... F42B 11/00

[52] U.S. Cl. ..... 102/505; 102/351; 102/393; 102/489

[58] Field of Search ..... 102/351, 357, 364, 393, 102/489, 503, 505, 202.13

[56] References Cited

U.S. PATENT DOCUMENTS

| | | | |
|---|---|---|---|
| 3,143,965 | 8/1964 | LaPointe . | |
| 3,150,848 | 9/1964 | Lager | 102/505 X |
| 3,308,759 | 3/1967 | Sorenson . | |
| 3,674,174 | 7/1972 | Crewe . | |
| 3,726,223 | 4/1973 | Moe . | |
| 3,837,278 | 9/1974 | Gustafsson et al. . | |
| 3,865,034 | 2/1975 | Boulter et al. | 102/393 |
| 3,899,975 | 8/1975 | Lawrence . | |
| 4,002,121 | 1/1977 | Prochnow et al. | 102/364 |
| 4,130,059 | 12/1978 | Block et al. | 102/505 X |
| 4,157,068 | 6/1979 | Rognmo | 102/489 |
| 4,178,854 | 12/1979 | Schillreff | 102/505 X |
| 4,183,302 | 1/1980 | Schillreff | 102/505 X |
| 4,195,571 | 4/1980 | Beeker et al. . | |
| 4,286,498 | 1/1981 | Block et al. | 102/505 X |

*Primary Examiner*—Peter A. Nelson

*Attorney, Agent, or Firm*—Robert P. Gibson; Anthony T. Lane; Max Yarmovsky

[57] ABSTRACT

A system for multistage aerial dispersion of materials or substances in minute form to provide an aerial array of interspaced clouds or cloud-like patterns of such materials or substances. Although the materials or substances may be in the nature of fertilizers, pesticides, herbicides and the like, suitable for domestic applications, there is basically disclosed a system for military applications. In this latter regard, rapid multipositional aerial dispersion of decoy material, such as thin metallic strips, chaff, or the like, to deceive or confuse enemy radar is achieved by packaging the decoy material in a carrier missile structured to carry a plurality of separate frangible canisters or modules respectively containing the decoy material in the form of a myriad of such metallic strips or chaff. The carrier missile while airborne is adapted to explosively shatter the canisters or modules in predetermined, timed sequence and thereby widely scatter their contents of metallic strips, or chaff, as a multitude of discrete dipolar elements to form a series of separate interspaced clouds or cloud-like regions of decoy material with each possessing the electronic or radar tracking characteristics simulating an airborne object, such as a helicopter or the like, desired to be protected from detection. Thus, the series of clouds or regions of decoy material conceal the actual locational position of the airborne object desired to be protected by producing multiple confusing tracking signals to devices relying upon such signals for detection and/or aiming purposes and thereby affording delay time to permit the real, or actual, airborne target to advance out of range of accurate detection and/or enemy weaponfire.

18 Claims, 7 Drawing Figures

SYSTEM FOR MULTISTAGE, AERIAL DISSEMINATION AND RAPID DISPERSION OF PRESELECTED SUBSTANCES

GOVERNMENTAL INTEREST

The invention described herein may be manufactured, licensed and used by or for the Government for governmental purposes without the payment to us of any royalties thereon.

BACKGROUND OF THE INVENTION

1. Field of the Invention

The present invention relates generally to missile or projectile systems for aerial transport and release of preselected substances into the atmosphere. In more particular respects, the present invention pertains to a system adapted to be launched along an aerial path of travel and during such travel to dispense one or more preselected substances into the atmosphere in a highly dispersed condition. In still further respects, the present invention concerns a deception system for aerial deployment to protect airborne objects from locational determination by various electronic or radar tracking and/or detection devices, and in more particular respects, pertains to a deception system which is adapted to be launched into an aerial path of travel and to dispel charges of lightweight debris, chaff, or the like, possessing the capability of simulating the electronic or radar tracking chracteristics, or pattern, depicted by a given airborne object and thereby screen or otherwise hinder, or impede, effective locational detection and determination of the airborne object or objects sought to be protected and especially relatively slowmoving aircraft, such as, for example, a helicopter or the like.

2. Description of the Prior Art

In the past, it has been a common tactic to attempt to disrupt the locational tracking capability of electronic or radar tracking devices by the ploy of aerially dispersing lightweight debris, or chaff, to divert or decoy, enemy gunfire and missiles away from friendly aircraft desired to be protected. Heretofore, although numerous types of decoy materials have been found to be suitable for the purpose of providing disruption of electronic or radar tracking signals, chaff, which is customarily composed of a multitude of discrete particles or separate masses of metallic or metallic-coated material structurally embodied in various forms, such as powder, thin strips, flakes, fibers, chips or the like, has been found to be especially suitable for such purposes.

Unlike the highly sophisticated and complex target-seeking and aiming types of systems in modern-day use, older radar and electronic tracking and aiming systems were relatively unsophisticated and susceptible to disruption of tracking signals by relatively unsophisticated means such as, for example, the manual dispensation of chaff through portals in the crew compartments of an airborne aircraft. Subsequently, such manual dispensation procedures gave way to more advanced forms of mechanical dispensation of radar-disrupting, chaff materials which, in turn, progressed to forceable, ejector systems of various forms, and ultimately to pyrotechnic-type ejectors. The technological advancement of such antidetection, or deception, devices was, however, accompanied by steadily evolving technological advances in opposing detection systems which such antidetection systems were being designed to disrupt. Thus, there has evolved over a period of time a progressive sequence of measures and countermeasures directed towards obtaining superiority, respectively, in the detection and the nondetection of airborne objects such as aircraft. Moreover, efforts at achieving such superiority have continued to constitute a major ongoing endeavor. Thus, despite the technological advancements which have heretofore been attained in counteracting the effectiveness of electronic and radar detection systems in locating and tracking airborne targets such as aircraft, significant further advances continue to be necessary in order to continue to provide requisite protection to friendly aircraft engaged in military operations. For example, while U.S. Pat. No. 4,195,571, issued Apr. 1, 1980 to Charles W. Beeker, one of the coinventors herein, and William J. Pribyl, discloses a unique system for aerial deployment and rapid explosive discharge and dispersal of a large quantity, or mass, of particulate chaff as a deceptive measure against radar detection and weaponfire, such a system has somewhat limited capabilities. For example, according to the concepts disclosed in the last-mentioned patent, the chaff is explosively discharged and disseminated over a large region to produce a relatively massive, single cloud of chaff material of sufficient size, quantity and concentration to effectively screen an aircraft located behind the cloud from actual locational detection by electronic surveillance devices, such as radar or the like. Moreover, although the cloud may also serve to provide a dummy target with which to decoy enemy fire away from the actual airborne target after the aircraft has advanced from behind the cloud, a 50—50 opportunity of correctly directing weaponfire to the actual target still remains. Moreover, since only two targets are the subject of choice, weaponfire may be quickly diverted from one target to the other before the actual target has adequate time to advance out of effective firing range. No less importantly, discriminating tracking devices and equipment can be readily systemized to direct dual weaponfire at both the dummy target and the actual target. Hence, the actual target may still remain in serious jeopardy of being destroyed, since only two projectiles or fire patterns would be required to provide assurance that weaponfire is being directed towards the actual or real target. Clearly, therefore, a system for providing a greater degree of deception for airborne objects, such as aircraft, is of utmost importance, and the attainment of such a system continues to remain a matter of significant consequence.

SUMMARY OF THE INVENTION

Broadly, the present invention embodies a unique system for aerial dispersion of a plurality of interspaced clouds or cloud-like patterns of particulate matter at aerial locations relatively remote from the launch site of the system. As such, the system permits aerial dispersion of substances over a relatively extended aerial path disposed above ground locations safely distant from the launch location. As such, widely varied military and domestic uses and applications of the system are envisioned which, among others, include aerial dispersion of decoy material for protection of aircraft against electronic and radar tracking devices; agricultural fertilizers, pesticides, herbicides, and the like; fire prevention and fire fighting substances especially suitable for large range, brush and forest fires, as well as, for example, cloud-seeding substances for rain propagation purposes and the like.

With the foregoing in mind and in accordance with a more specific aspect, the present invention embodies a unique system adapted for aerial deployment and multi-stage aerial dissemination of clouds or cloud-like patterns of myriad, randomly distributed, decoy material, such as strips and/or particles of chaff possessing dipolar characteristics tailored to simulate the appearance of an airborne aircraft such as, for example, a helicopter, a small aircraft or other airborne object sought to be protected from locational detection or discrimination by electronic surveillance systems, such as radar detection, or the like. Such protection is afforded by means of an innovative system in which a plurality of charges of decoy material are sequentially disseminated by the system during aerial flight thereof along an extended trajectory or path of travel. Otherwise stated, subsequent to launching of the system, dissemination of the decoy material is effected in sequentially programmed intervals to provide an aerial interspacing of clouds or cloud-like patterns, or regions, of decoy material. The sequential intervals at which such dissemination is effected are optionally preselected to provide optimal target confusion and delay to a skilled operator of electronic or radar detection systems. More particularly, and in accordance with one preferential or more limited aspect, the present invention is designed to distribute the decoy material in such manner as to form an interspaced aerial array of separate cloud-like regions of decoy material at locational intervals ranging from about 150 to about 200 meters apart. As a result, a highly effective diversion in the form of plural dummy targets will be presented and the time required to conduct individualized observational verification of each remotely interspaced dummy target will afford the real or actual target ample opportunity to advance out of accurate range of enemy weaponfire before being selectively identified.

By way of structural embodiment of the foregoing aspects of the present invention, the deception system may be generally characterized as comprising:

carrier means adapted to be propelled along a path of aerial travel;

a plurality of containers for containing separate batches of at least one aerially dispersible substance selected to possess properties capable of accomplishing a predetermined objective and being carried by the carrier means; and means for explosively shattering the respective containers in periodic sequence and propelling the dispersible substance or substances radially outward from the carrier means at successive periodic intervals during the aerial travel thereof;

whereby an interspaced succession of airborne regions of the dispersible substance will be deployed along the path of aerial travel of the carrier means.

In accordance with a more specific structural embodiment tailored to protect airborne objects from locational detection by electronic and/or radar tracking and detection systems, the deception system may be further characterized, as comprising:

carrier means adapted to be propelled along a path of aerial travel;

a plurality of frangible canisters securely carried by the carrier means and respectively containing decoy material; and means for explosively shattering the respective canisters in periodic sequence and propelling the decoy material radially outward from the carrier means at successive periodic intervals during the aerial travel thereof;

whereby an interspaced succession of airborne regions of decoy material will be deployed along the path of aerial travel of the carrier means.

In accordance with a still more limited characterization, the deception system of the present invention includes a carrier having a leading or forward end portion, a trailing or aft end portion and an intermediate portion in the form of an open framework structure securely interconnected between the forward and aft end portions and comprised of a plurality of axially elongated and laterally or radially interspaced support rods. The forward and aft end portions are adapted to be mounted respectively to a forward end member, such as an ogive, or nose cone, and to an aft propulsion unit, such as, for example, a rocket motor or the like. In addition to interconnecting the forward and aft end portions, the support rods are also structured to retain a longitudinally deployed group of frangible canisters of decoy material and a group of highly impact-resistant, protective partitions, or shields arranged in alternating succession with the frangible canisters to protectively shield each of the canisters from potential damage resulting from the explosive shattering of another one of the canister group. Explosive shattering of the canisters is achieved by means of an explosive charge individually associated with one each of the canisters. Each explosive charge is selected to possess sufficient explosive force to shatter an associated canister and propel and disseminate the decoy material contained therein over a region of airspace of sufficient extent to simulate the appearance an aerial object such as a helicopter, or the like, would present to an electronic or radar detection system. In accordance with a particularly significant feature of the deception system, detonating means are provided for intercooperatively, but separately, detonating the explosive charges in preselected timed sequence to thereby produce an aerially interspaced array of regions, or cloud-like patterns, of decoy material simulating an aerially interspaced group of aircraft and to thereby present and impart multiple misleading and confusing observation patterns upon detection thereof by electronic or radar detection devices.

In keeping with the foregoing, a principal objective of the present invention is the provision of a system for aerial dispersion of a plurality of separately contained batches of at least one aerially dispersible substance possessing properties suitable for accomplishing a predetermined objective following aerial release and dispersion thereof and which is capable of separately releasing and dispersing each of such batches in such manner as to provide a periodic succession of clouds or cloud-like patterns thereof deployed along the path of aerial travel of the systems.

Another objective is the provision of a system embodying the last-mentioned characteristics and which is also capable of explosively disseminating or dispersing each of the batches of dispersible substance in such manner as to form a sequence of clouds or cloud-like patterns thereof.

Another objective is the provision of a system which, in addition to possessing the capabilities of the foregoing objectives, is also capable of wide and varied usage in such technological areas such as, for example, agriculture, forestry preservation, hydrometeorology, among others.

Another more specific objective is the provision of a deception system capable of being launched along an airborne trajectory or path of travel and while advancing along such path of travel providing deceptive dummy targets affording an enhanced measure of defensive protection for an airborne object such as an aircraft and, particularly, a relatively slow-moving aircraft, such as a helicopter or small observational craft.

Another objective is the provision of a deception system capable of accomplishing the foregoing objective by means of effecting an airborne deployment of a plurality of clouds or cloud-like regions respectively containing particulate, dipolar, decoy material and simulating the characteristics of an airborne object, such as an aircraft, when detected and observed by electronic or radar surveillance devices.

Another objective is the provision of a deception system which is of relatively lightweight design and readily adaptable for employment in operative association with presently available aerial launching and/or propulsion systems.

A further objective is a provision of a reliable system which is capable of fulfilling the foregoing objectives and which also is sufficiently compact to render it suitable for multiple quantity transport and launching from a flying aircraft, and especially from a smaller, slower moving, type of aircraft, such as a helicopter or smaller observation aircraft and the like.

A still further objective is the provision of a system which, in addition to possessing the above-mentioned capability, is also capable of being launched along an extended trajectory or path of airborne travel to thereby accommodate deployment of a series of clouds or cloud-like regions of decoy material at several aerial locations progressively remote from the launching site.

An additional and more particular objective of the present invention is the provision of a system which is capable of reliably fulfilling the foregoing objectives without necessitating the utilization of relatively expensive, sophisticated or delicate components.

The specific nature of the present invention, as well as other objectives, features and advantages thereof, will become readily apparent to those ordinarily skilled in the art from the following detailed description taken in conjunction with the annexed drawings wherein, by way of example only, a preferred embodiment of the invention is respectively described and illustrated.

BRIEF DESCRIPTION OF THE DRAWINGS

FIG. 2 is a partially fragmentary, perspective view of the deception system of the present invention and, for purposes of enhanced clarity of description and understanding, illustrating the system with certain portions removed and with certain portions of the interior structure sectioned, and further illustrating the system with the leading end thereof bearing a nose cone and with the trailing end thereof suitably adapted for mounted assembly with a launching and/or propulsion unit, such as, for example, a rocket engine or the like.

DETAILED DESCRIPTION OF THE INVENTION

Figure 1:
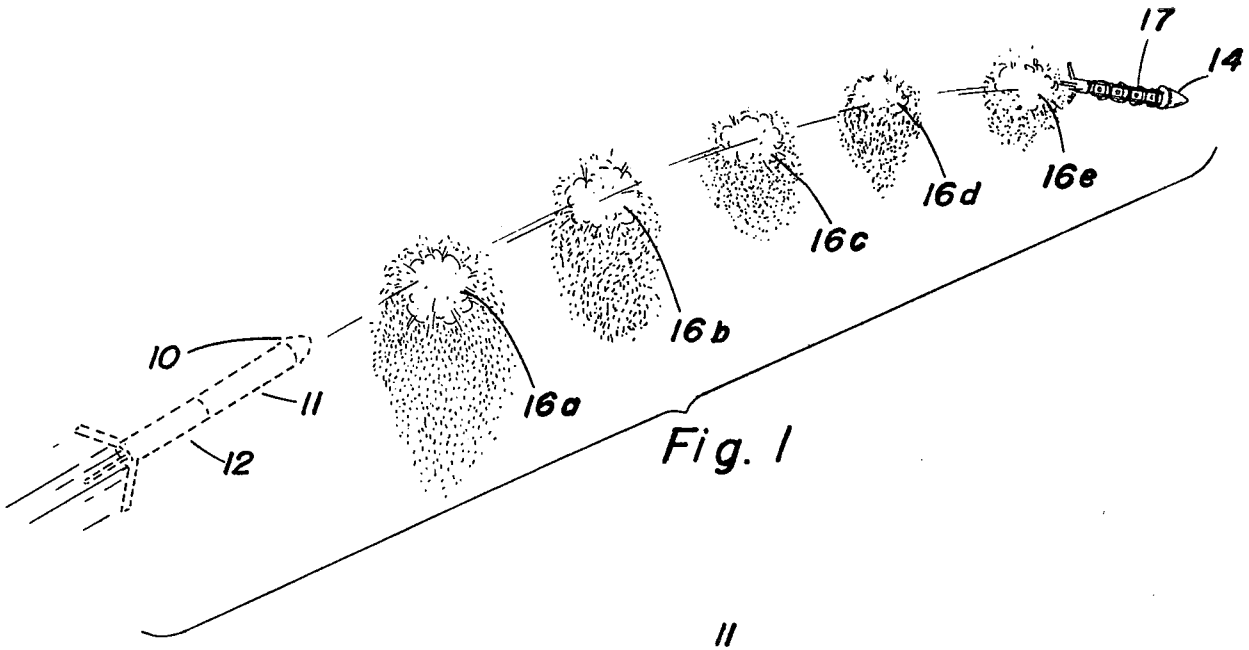
FIG. 1 is a long-range perspective view schematically depicting the operational characteristics of the deception system of the present invention and illustrating the same according to one preferred aspect as being embodied in a self-propelled missile, or projectile system.

As will be readily understood and appreciated from the following detailed description, the deception system of the present invention is structurally designed in such manner that it is readily adaptable for aerial deployment in operative association with various forms of launching and propulsion systems such as, among others, ground launched or aerially launched missile or projectile systems. With this in mind, the deception system of the present invention is optionally depicted in FIG. 1 as being preferentially embodied in a missile 10 utilizing a propulsion system in which the missile is propelled by a conventional rocket motor. More specifically, the missile is schematically illustrated as propelling the deception system 11 along an aerial trajectory, or path of travel, by a suitable rocket engine 12. As more clearly shown in FIG. 2, the aft or trailing end 13 of the deception system 11 is adapted to be mounted onto the rocket engine 12 or other propulsion system, and to impart balance, stability and optimum flight performance thereto, a nose cone 14, or other similar suitable end member, or ogive, is mounted on the forward or leading end 15 of the deception system. In accordance with the basic operational features, the deception system is designed to disseminate a sequential succession of cloud-like patterns, or regions, composed of a myriad array of particulate decoy material possessing the characteristics of being detectable by electronic tracking devices such as infrared, laser and particularly radar surveillance systems. In FIG. 1, five such cloud-like regions or patterns **16*a*, 16*b*, 16*c*, 16*d* and 16*e* are depicted as being representative of the operational characteristics of the system and each of the cloud-like regions is selectively tailored to provide a simulation of an airborne object, such as a helicopter, or the like, when detected by an electronic surveillance system. Thus, in the instance depicted in FIG. 1**, an aerially interspaced array of five such airborne objects, or potential targets, will be detected by an electronic tracking system to thereby provide multiple confusion and substantial delay in attempting to verify the location of the real or true target objective. Obviously such confusion may be further enhanced by launching in rapid sequence a plurality of such deception systems in differing trajectories and/or directions selected to produce a randomly patterned array of bursts and thereby disrupt attempts to observationally track or accurately project the flight paths of the systems.

Figure 2:
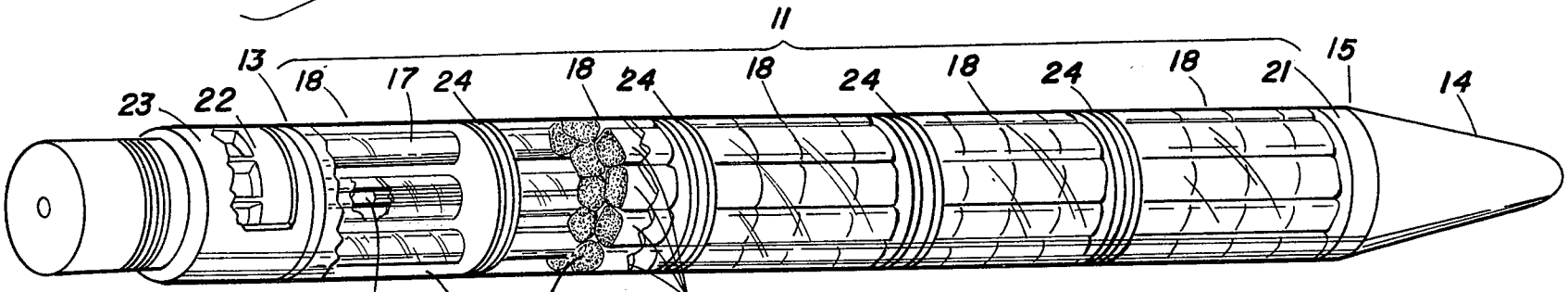

Briefly, the deception system 11, which is shown as being incorporated into the missile 10, includes carrier means 17, a plurality of frangible canisters 18 securely carried by the carrier means 17 and respectively containing decoy material 19, and means (shown in part at 20) for explosively shattering the canisters 18 in periodic succession to thereby propel the decoy material radially outward from the carrier means at successive periodic intervals during aerial flight or travel of the system 11; whereby, a resulting interspaced succession of airborne regions 16*a*, 16*b*, 16*c*, 16*d* and 16*e* of decoy material will be deployed along the path of airborne flight, or travel, of the system 11. Also, as indicated above, the deception system 11 is adapted to be launched as a component member or section of a missile and, as best shown in FIG. 2, for such purpose the carrier means 17, or more simply the carrier, is provided at its leading end 15 with means such as a transverse end member or forward mounting hub 21 for securely mounting the axially projecting ogive or nose cone 14 thereon. In similar manner, the trailing end 13 of the system is provided with suitable means, such as a transverse end member or aft mounting hub 22, or the like, for securely mounting an adapter 23 which, in turn, serves as a mounting for a launching and/or propulsion unit, such as the rocket propulsion engine 12. The rocket propulsion engine 12, although not a part of the present invention, is representative of one preferred means of launching the missile 10 into an aerial trajectory, or path of travel. As further shown, the deception system 11 also includes means in the form of highly impact-resistant partitions, or shields 24, for protectively shielding each of the canisters 18 from subjection to damage potentially resulting from the explosive forces generated during the explosive shattering of other ones of the group of canisters.

Figure 3:
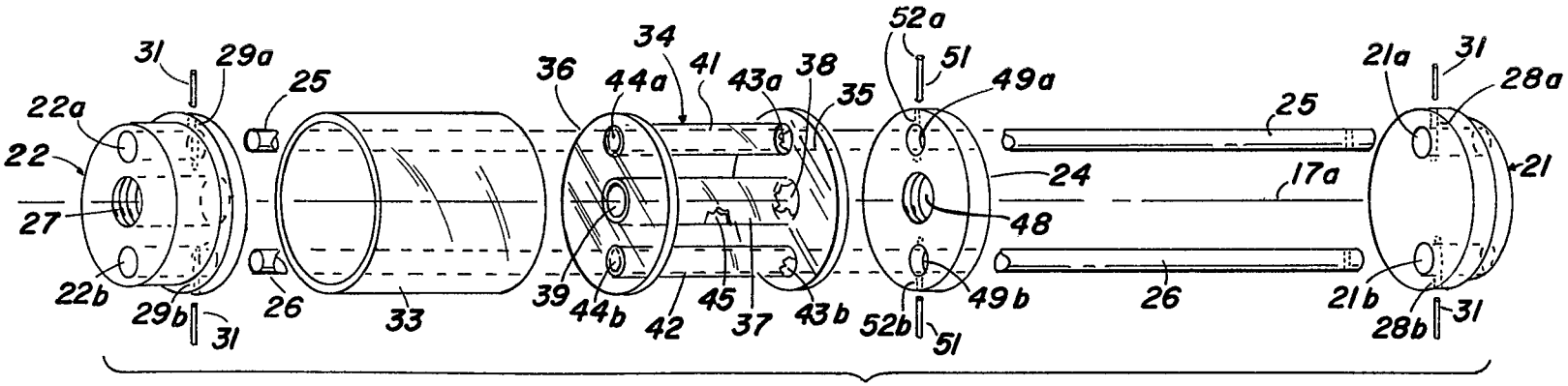
FIG. 3 is a partial, exploded view of the system depicted in FIG. 2 more clearly showing the cooperative structural interrelationship of certain component members of the system.
Figure 4:
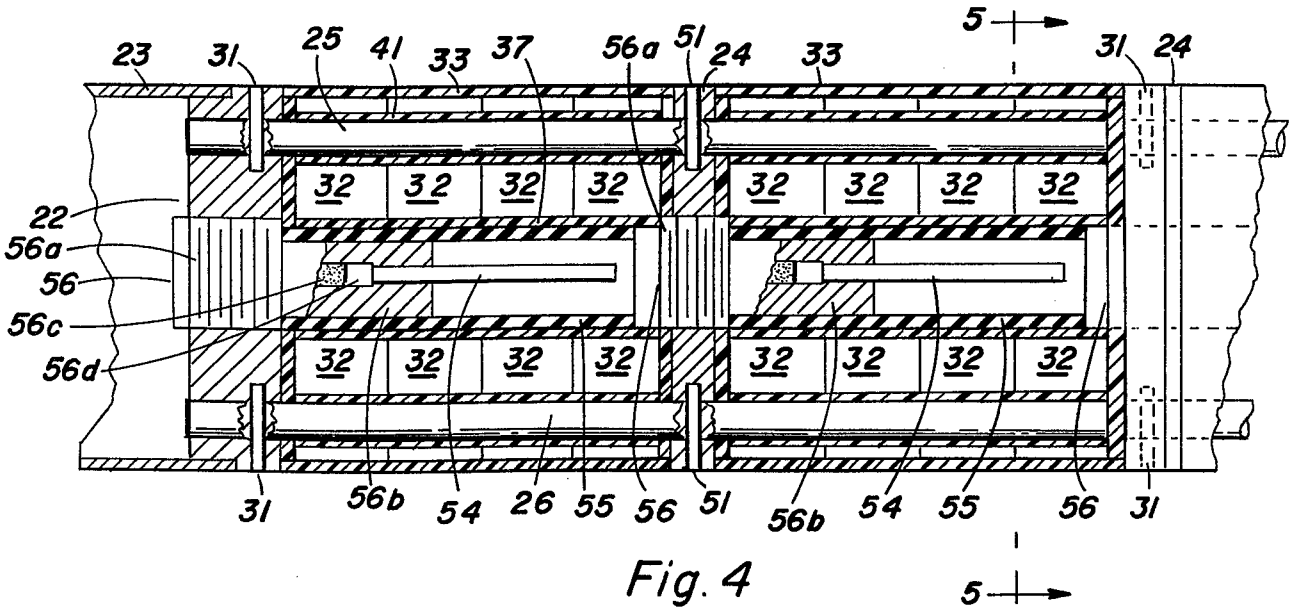
FIG. 4 is an enlarged central, longitudinal, sectional view of an aft portion of the system depicted in FIG. 2.

As best observed in FIGS. 3 and 4, the carrier 17 defines an axially elongated open-framework structure comprised of a plurality of longitudinally extending and laterally interspaced frame members, such as axially elongated support rods 25 and 26 terminally interconnected, respectively, at each opposite end with the forward and aft mounting hubs 21 and 22. To this end, the forward and aft mounting hubs 21 and 22 are each provided with mutually coaligned journal openings 21*a*, 21*b* and 22*a*, 22*b* radially and equally offset from the central axis of each hub and in which to receive one each of the opposite ends of each of the rods. Thus, as shown, the journal openings 21*a* and 21*b* in the forward mounting hub 21 are arranged to be coaligned with the journal openings 22*a* and 22*b* in the aft mounting hub 22 and thereby orient the rods 25 and 26 in mutually parallel and equally, radially interspaced relationship with respect to the longitudinal axis 17*a* (FIG. 3) of the carrier 17. Also, as shown, the aft mounting hub 22 further defines a central bore, as at 27, extending transversely therethrough and arranged to register in coaxial alignment with the longitudinal axis 17*a* of the carrier 17 when the rods 25 and 26 are received in the hub journal openings 21*a*, 21*b*, 22*a* and 22*b*. Securement of the ends of the support rods 26 and 26 within the journal openings may be accomplished by use of any of various suitable and conventional fastening means. One such form of fastening means, as shown, is by the provision of peripherally interspaced ports 28*a*, 28*b* and 29*a*, 29*b* extending radially through the respective mounting hubs 21 and 22 to the journal openings 21*a*, 21*b* and 22*a*, 22*b* and accommodating journal pins 31 journaled radially into the leading and trailing ends of the rods 25 and 26.

Figure 7:
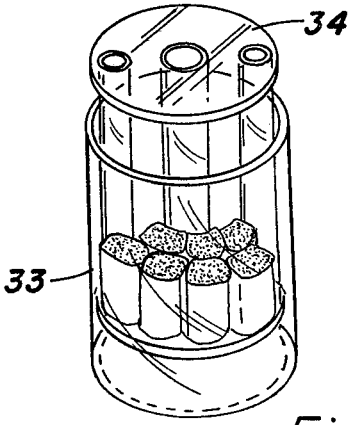
FIG. 7 is an isolated view of the frangible canister component of the system, and schematically depicts the same during the process of being loaded with muffins of decoy material of the type more clearly shown in FIG. 6.

Referring again to FIG. 2 and also FIG. 4, the canisters 18, preloaded with slugs or "muffins" 32 of decoy material 19, are securely assembled on the carrier 17 intermediate the forward and aft mounting hubs 21 and 22 by means of being journaled on the frame members, or support rods 25 and 26, in linear, alternating succession with an axially interspaced succession of the protective partitions or shields 24 which are likewise journaled on the support rods and transversely span and compartmentalize the carrier 17. As thus arranged, the shields mutually separate the canisters 18 from one another and provide an effective means for protectively shielding each canister against potential damage resulting from the explosive shattering of another one of the group. As best represented in FIGS. 3 and 7, each canister 18 comprises a two-part unit composed of a frangible tubular, open-ended, outer casing 33 and a generally spool-shaped insert 34 adapted to be telescopically received within the outer casing 33 in relatively snug, slip-fit relationship and provided with annular, marginally apertured endwalls 35 and 36 disposed in interspaced coaxially aligned relationship and shaped to snugly close the opposite open ends of the outer casing 33. Interconnected with the opposite endwalls 35 and 36 of the insert 34, there is an axially elongated central tube, or inner casing 37, axially communicating with central access openings 38 and 39 respectively defined in and extending transversely through the endwalls. Flanking the inner casing 37 in mutually parallel and radially interspaced relationship, there are a pair of tubular sleeves 41 and 42 respectively having oppositely disposed open ends integrally connected with the endwalls 35 and 36 and openly communicating with marginal pairs of apertures 43*a*, 43*b* and 44*a*, 44*b* extending transversely through each of the last-mentioned endwalls and arranged to axially register with and receive the carrier support rods 25 and 26. When assembled together with the insert 34 telescopically nested within the outer casing 33, the insert endwalls 35 and 36 effect a relatively snug-fitting closure of the opposite open ends of the outer casing. Also, when so assembled, the inner casing 34 provides an axially extending inner chamber, as at 45, therewithin leading between the access openings 38 and 39 and also cooperates with the outer casing 33 to define a generally annular outer chamber, as at 46 in FIG. 2, surrounding the inner chamber 45 and longitudinally traversed by the sleeves 41 and 42. Within the outer chamber 46, space is provided for housing a quantity of muffins 32 of decoy material 19 snugly clustered, or compactly nested around the sleeves 41 and 42.

The protective partitions, or shields 24, (in the illustrated embodiment being shown as four in number) are preferably fabricated from relatively high-impact-resistant steel plate or other similar impact-resistant material of sufficient strength and thickness to effectively withstand the explosive forces and attendant flying debris generated as a result of detonation of each of the frangible canisters 18. Structurally, each of the shields 24 preferably defines a peripheral configuration essentially corresponding to the exterior peripheral shape and dimensions of an assembled canister, and each is provided with a central bore, at 48, and marginal, equally-interspaced, transverse, mounting apertures 49*a* and 49*b* corresponding in number to the number of carrier rods 25 and 26. As shown, the marginally interspaced apertures 49*a* and 49*b* in each shield 24 are oriented to register with and receive the carrier rods 25 and 26 therethrough in slip-fit relationship, whereas the central bore 48 of each is oriented to axially register with the inner chamber 45 of a canister 18. In similar manner to that of the forward and aft mounting hubs 21 and 22, each of the shields 24 is also adapted to be suitably locked in assembled position on each of the carrier rods 25 and 26 by suitable fastening means, such as, for example, roll pins 51 inserted in radially disposed peripheral ports 52*a* and 52*b* interspaced about the periphery of the shields 24 and securely engaging the carrier rods within the marginal apertures 49*a* and 49*b* in the shields.

Figure 5:
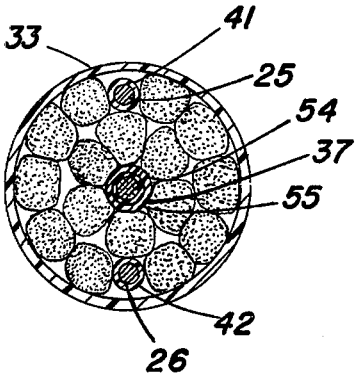
FIG. 5 is a transverse sectional view of the system taken along and in the viewing direction of the sectional plane 5—5 in FIG. 4.

As best observed in FIGS. 4 and 5, the means for explosively shattering the canisters 18 in periodically timed sequence, or stages, includes an axially aligned series of conventional, pyrotechnic-type, time-delay fuse assemblies individually arranged to project coaxially within the inner chamber 45 of one each of the canisters 18. In the illustrated embodiment, five such time-delay fuses are representatively employed with five such canisters. Each of the fuse assemblies includes a length of conventional primacord 54 and a conventional time-delay fuse 56 having a threaded end portion 56*a* and an axially extending shank portion 56*b* axially traversed by a hollow bore containing an igniter composition 56*c* and a detonator 56*d* and within which to receive and retain one end portion of a length of primacord 54. One such typical and suitable type of time-delay fuse is shown and described in U.S. Pat. No. 4,221,167, issued Sept. 9, 1980 and assigned to the assignee hereof. As described in the last-mentioned patent, the time-delay fuse employs, as an igniter composition, a gasless ignition powder such as TYP A-1A, MIL-P-22264 with an additive of 1 percent varnish. As further described, the detonator, which is disposed intermediate the igniter composition and the primacord, may be a type M35, as defined in MIL-D-46207. Although a 100 grain primacord is described as being usable for the delay fuse described in the referenced patent, a less forceful explosive charge, such as would be provided by a 30–40 grain PETN/FT primacord, available from Ensign-Brickford Co. of Simsbury, Conn., ordinarily would be more preferable and less conducive to causation of damage to other intact canisters in the group, as well as to other structural components of the system. As shown, the threaded end portion 56*a* of the rearwardmost time-delay fuse is threadably received within the internally threaded central bore 27 in the aft mounting hub 22. In similar manner, the threaded end portion of one each of the other time-delay fuses 56 is threadably received within the threaded central bore 48 in one each of the partitions or shields 24. Also, projecting coaxially within the inner chamber 45 of each canister 18 and surrounding each length of primacord, there is a tubular, elastomeric insulator, or sleeve 55, such as a rubber tube, which fits snugly over the shank portion of the time-delay fuse 56 and covers the exposed length of primacord. The sleeve 55 functions as an expandable insulator to prevent potential searing or burning of the decoy material 19 by hot, flying sparks, particles or fragments of primacord material occurring during explosive shattering of the canisters. Being expandable, however, the sleeve 55 will readily distend in response to the internal explosive forces generated as a result of detonation of the primacord and consequently permit such forces to be transmitted against and explosively shatter each of the canisters from within.

Figure 6:
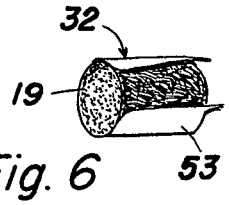
FIG. 6 is an enlarged perspective view of an individual package, or "muffin", having a multitudinous, closely packed, array of strands and/or particulate dipolar decoy material suitable for regional, aerial distribution to form a cloud or cloud-like pattern of such decoy material.

The packaged bundles, or slugs, or so-called "muffins" 32 of decoy material 19 contained within each of the canisters 18 are respectively composed of strips, strands and/or particles of metallic material or other similar material possessing dipolar characteristics capable, when dispersed in the atmosphere, of stimulating a detectable response by electronic tracking or scanning systems, particularly radar systems, and of simulating the type of response produced by a small, slow-moving aircraft. As best shown in FIG. 7, the muffins are preferably loaded compactly into the tubular outer cashing 33 concurrent with telescopic insertion of the spool-shaped insert 34 into the outer casing 33, whereby they may be snugly clustered, or nested, around the sleeves 41, 42 and inner casing 37. In the particular embodiment shown in FIG. 2, fifty-six muffins 32 are, representatively, snugly nested, or packed, within the outer chamber 46 of each filled canister 18 wherein, as compared to FIG. 6, they are shown as being slightly deformed in shape as the result of being tightly clustered around the exterior periphery of the inner casing 37 and sleeves 41 and 42. Upon completion of the loading of each muffin-filled canister 18, the canister is preferably sealed to render it impervious to moisture penetration. To this end, each of the opposite endwalls 35 and 36 of insert 34 may be peripherally or marginally sealed to the tubular outer casing 33 with any of various compatible sealant materials capable of forming an adherent, moisture-proof seal between the endwall and outer casing components of the canister. As a suitable example of compatible materials, the canister components may be molded from a phenolic resin and sealed with liquid ethylene chloride which acts as a phenolic solvent and functions to firmly bond the phenolic canister components together in moisture impervious relationship.

The packaged bundles, slugs or muffins 32 of decoy material preferably may be of a known and readily available type, such as previously have been used by the United States Armed Services, particularly the Navy, for efficiently disseminating metallic chaff as a means of countering radar. Customarily such muffins contain "hanks" or a great number of strands of metal chaff providing approximately 200,000 dipoles. As best observed in FIG. 6, the strands and/or particles of decoy material 19 are wrapped or rolled within one or more layers of a thin, moisture-impervious, plastic film 53 such as, for example, a thin film of polyethylene terephthalate resin and which is commercially available from E. I. DuPont de Nemoir and Company of Wilmington, Delaware, under the trademark Mylar. In operation, the number of layers of film wrapping proportionately determines the rate of chaff release from the muffin and the distance which the muffin is hurled from the canister 18 prior to unfurling and releasing the chaff. The length of the strands of chaff determines the radar wavelength upon which the chaff will be most effective. No less importantly, the dipoles should be similarly aligned in order for the chaff to be most effective. The chaff material is preferably selected from light metals, metal alloys and/or metal coated nylon and fiberglass. For example, suitable chaff has been prepared from such metals as aluminum, zinc and copper, as well as alloys, such as bronze and aluminum coated nylon and fiberglass. As a countermeasure against infrared detection, metal powders, such as aluminum, boron, magnesium, titanium, silicon, and mixtures thereof, can be suitably employed. By adding carbon in the form of charcoal and graphite, a countermeasure to laser detection may be provided.

The chaff after being explosively discharged will be disseminated rapidly to form an effective cloud or cloud-like region of decoy material and will provide an effective dummy target which, depending upon weather conditions, will persist for up to about 90 seconds and provide ample confusion and delay time to permit the true target to move out of range of enemy weaponfire. Obviously, additional confusion and delay time can be obtained by launching a salvo of missiles 10 in various trajectories to produce an extensive random pattern of cloud-like regions of decoy material.

MANNER OF ASSEMBLY

In accordance with one, among others, manner of assembly of the deception system 11, the time-delay fuses 56, after being fitted with primacord, may be threadably secured in place within the central bores 27 and 48 in the aft mounting hub 22 and respective partitions or shields 24, following which an elastic insulator 55 may be axially slipped over the primacord and onto the shank portion 56*b* of each delay fuse. Thereafter, assembly of the forward and aft mounting hubs 21 and 22, sealed canisters 18 preloaded with decoy material 19, shields 24, and support rods 25, 26 may be quickly accomplished by successively sliding the mounting hubs, canisters and shields onto the support rods in the order of arrangement depicted in the drawings and by thereafter securing same in fixed position on the support rods by means of journal pins 31 and roll pins 51. As thus assembled, the system may be secured to an appropriately selected forward end member such as, for example, a nose cone 14 of the general type illustrated and be mounted, employing a suitable adapter when necessary, to a selected launching or propulsion system.

MODE OF OPERATION

Operationally, the multistage system, either when embodied in a projectile or in a missile, such as the missile 10, hereinbefore referred to for descriptive purposes, after being launched and after having travelled to the vicinity of the selected target region, is actuated by a conventional pyrotechnic triggering or fusing device, not shown, which ignites the igniter composition 56*c* carried in the delay fuse 56 mounted in the aft mounting hub 22; such ignition being accomplished by accessing the igniter composition through the central bore opening in the end face of the threaded end 56*a* of the fuse. Following ignition, the igniter composition continues to burn for a predesigned period of time after which it ignites the detonator 56*d* which, in turn, detonates the explosive charge of primacord 54 coaxially nested within the tubular elastomeric sleeve 55 and projecting axially from the shank portion 56*b* of the time-delay fuse into the interior of the inner casing 37 of a counterpart canister 18 operatively associated with the first stage of the system. The resulting explosive forces generated by the explosive blast of the primacord cause the expandable tubular sleeve 55 to immediately, rapidly distend radially outward with a sufficient force to explosively shatter the surrounding frangible first-stage canister 18 and concomitantly disseminate the decoy material contained therein in a highly comminuted form over a widely dispersed region to form a first cloud or cloud-like region of decoy material, such as chaff, of sufficient extent and density to simulate the characteristics of a helicopter or small, slow-moving aircraft as viewed by a radar screen observer.

The second stage time-delay fuse 56 disposed adjacent to and next forwardly of the first-stage, delay fuse is activated in response to detonation of the first-stage primacord. More particularly, detonation of the length of primacord in the first stage of the system produces a flash of fire and heat which serves to ignite the igniter composition in the second-stage, time-delay fuse. Thereafter, the functional sequence described with respect to the first-stage, time-delay fuse, including explosive shattering of the second stage canister, is repeated during the course of an elapsed time period governed by the predesigned delay time for combustible consumption of the igniter composition contained in the second stage, time-delay fuse. Similarly, the sequence of time-delay fuse ignition and explosive, canister shattering is successively repeated in a forwardly direction leading through the third, fourth and ultimately the fifth-stage canister located adject to the forward or leading end 15 of the carrier 17. As a result, a sequential array of clouds or cloud-like regions of decoy material are produced along the path of aerial travel of the system; each of which provides a radar appearance confusingly similar to that produced by a helicopter or relatively small, slow-moving aircraft.

The presence of the expandable, elastomeric sleeve 55 provides significant and notable structural and functional features. In addition to providing an effective means of transferring the explosive forces generated by detonation of the primacord, the sleeve also functions as an effective and protective insulator which shields the plastic, film-wrap portion 53 of the individual muffins 32 of decoy material from heat and fire damage attending detonation of the primacord. More specifically, the detonation of the primacord customarily produces a momentary flash of heat and fire, such as a fire ball, which, since it occurs simultaneously with the exposive shattering of a canister, is capable of searing, burning or melting the plastic film-wrap 53 surrounding the individual muffins of decoy material. As a consequence, failure to protectively insulate the muffins of decoy material from the effects of such heat and fire would seriously impede the capability of the plastic film 53 to properly unwrap following explosive expulsion of the muffins and thereby impair its ability to effectively scatter and disseminate the decoy material packaged therewithin.

As a representative example of a specific missile embodying a deception system characterizing the present invention, a standard 2.75 inch diameter U.S. Army rocket motor was selected and by means of an adaptive mounting element was mounted onto a five stage deception system of the type depicted in the drawings. The deception system measured approximately 2.75 inches in diameter and approximately 18.25 inches in length, and when assembled to a nose cone and the rocket motor provided a completed missile having an overall length of about 26 inches and an overall weight of between about 25–30 pounds.

Each of the respective time-delay fuses contained an igniter composition charge designed to provide a 0.5 second delay period. A pyrotechnic triggering device in the form of a slightly modified, standard WDU4 A/A motor burn-out fuse installed intermediate the rocket motor and the aft or first-stage, time-delay fuse provided the means for activation of the first-stage, time-delay fuse.

As thus assembled and armed, the missile was launched from an airborne helicopter and provided a series of five detonations forming a succession of five, separate, cloud-like regions of decoy material interspaced at intervals of approximately 160 meters and commencing about 500 meters from the site of burn-out of the rocket motor. Each region of decoy material was evenly dispersed and provided a radar, cross-section value simulating the radar appearance of a helicopter, or small, observational aircraft, or the like.

Thus, from the above specific example, it will be clearly evident that the innovative concepts of the present invention are particularly well-suited for utilization where a relatively small and lightweight structure is desired. Moreover, the system is capable of adaption to airborne launching as well as ground launching systems, either as a projectile or as a self-propelled missile. No less importantly, the invention is readily suitable to employment in a wide variety of utilitarian applications other than as a countermeasure against electronic surveillance systems. In such other applications, the particular nature of use and desired objective would, of course, dictate the type of material best suited to be packaged in the respective canisters.

It will, of course, be understood that various details of construction, combination and assembly may be modified throughout a wide range of equivalents, and it is, therefore, not the purpose to limit the scope of the present invention otherwise than as necessitated by the scope of the appended claims.

We claim:

1. A rocket deception system for aerial dissemination of a plurality of separate batches of at least one prepackaged material in highly dispersed condition and for producing a plurality of separate chaff clouds each comprised of material for protecting airborne objects from radar tracking devices, said system comprising:

a rocket engine for propelling said rocket system;

a carrier fixedly attached to said rocket engine having an open framework structure extending between oppositely disposed forward and aft end members;

a succession of longitudinally disposed frangible canisters carried in said open framework between said forward and aft end members in which to respectively package a selected substance or material which includes, a tubular inner casing defining an inner chamber, an outer casing surrounding said inner casing, said outer casing and said inner casing cooperating to define an outer chamber therebetween within which to package a selected material;

means for protectively shielding each of said canisters from explosive forces generated during explosive shattering of another canister, which includes;

a plurality of explosion-resistant partitions secured on said carrier and operatively deployed between and separating successive canisters from one another; and means for explosively shattering said canisters in periodic sequence and forcefully propelling the material packaged therein radially outward from said carrier and disseminating the material in highly dispersed condition to form a plurality of separately spaced apart clouds.

2. A system as defined in claim 1, wherein said means for explosively shattering said canisters comprises a plurality of separate explosive charges individually disposed within the inner chamber of one each of said canisters and respectively being of sufficient explosive force to shatter the canister within which it is disposed and forcefully propel the substance or material packaged within the outer chamber of such canister radially outward from said carrier and to disseminate same in highly dispersed condition.

3. A system as defined in claim 2, wherein said explosive charges are respectively surrounded by an elastomeric sleeve extending within the inner chamber of each respective canister, each said sleeve being adequately expandable to accommodate transmission of sufficient explosive forces from the explosive charge therewithin to explosively shatter the canister within which said sleeve extends while concurrently serving to insulate the substance or material within the canister from hot flying sparks, particles and fragments occurring during explosive shattering thereof.

4. A system as defined in claim 2, wherein said means for explosively shattering said canisters in periodic sequence further comprises a series of time-delay fuses for respectively detonating the explosive charge within one each of the linear succession of canisters and wherein said time-delay fuses are adapted to detonate said explosive charges in periodic sequence commencing with the explosive charge in the canister proximate to said aft end of the carrier and thereafter to detonate in periodic sequence and in linear succession the explosive charge in each of the other canisters.

5. A system as defined in claim 1, 2, 3, or 4 wherein said system is a deception system adapted to impede locational radar detection of airborne objects such as aircraft, and wherein said canisters respectively have a quantity of decoy material packaged therewithin.

6. A deception system as defined in claim 5 wherein each said canister contains a sufficient quantity of decoy material to simulate the detection signal received by an electronic detection device upon detection by the device of an airborne aircraft.

7. A rocket system adapted to be launched along an aerial path of travel and during such travel to sequentially disseminate a plurality of batches of at least one preselected substance into the atmosphere in a highly dispersed condition and in such manner as to form an aerial array of cloud-like regions of such substance or substances, said system comprising:

a rocket engine for propelling said rocket system;

an axially elongated carrier fixedly attached to said rocket engine having an open framework extending longitudinally between and interconnecting at each opposite end respectively with a leading end member and a trailing end member;

a group of frangible canisters carried in said open framework between said leading and trailing end members in interspaced end-to-end alignment and respectively containing at least one preselected substance capable of being disseminated in a highly dispersed condition in response to explosive ejection from its respective canister;

a series of explosive charges arranged on said carrier for separately explosively shattering each canister and explosively ejecting said substance radially outward from said carrier in a highly dispersed condition; and means for protectively shielding each of said canisters from said explosive charges, which includes;

a plurality of explosion resistant partitions secured on said carrier and disposed intermediate each of said canisters;

detonating means for separately detonating said explosive charges in sequentially timed relationship; thereby producing a sequential array of separate cloud-like regions of the highly dispersed substance along the path of aerial flight of said system.

8. A system as defined in claim 7, wherein the leading end member of said carrier provides a forward mounting hub at the leading end thereof and said trailing end member provides an aft mounting hub at the trailing end thereof, said forward mounting hub including means for securely interconnecting the leading end of said carrier to a nose member and said aft mounting hub including means for securely interconnecting the trailing end of said carrier with means for launching or propelling said system along an aerial path of travel.

9. A system as defined in claim 8, wherein said detonating means is adapted to sequentially detonate said explosive charges in a sequential order commencing with the explosive charge for shattering the canister disposed in closest proximity to the trailing end of said carrier and thereafter detontating the explosive charges for shattering the other of said canisters in successive sequence advancing from the trailing end towards the leading end of said carrier.

10. A system as defined in claim 7, wherein said carrier comprises a plurality of axially elongated and mutually interspaced frame members reaching between and interconnecting with the leading and trailing ends of said carrier, and wherein said shielding means comprises a plurality of highly impact-resistant partitions to shield said canisters from damage potentially resulting from explosive shattering of another of said canisters, one each of said partitions being arranged in each interspace between adjacent canisters and defining marginally deployed transverse mounting apertures journably receiving said frame members therethrough.

11. A system as defined in claim 10, wherein each of said canisters comprises a tubular outer casing in surrounding radially interspaced relationship with a tubular inner casing and oppositely disposed annular endwalls spanning the interspace between said inner and outer casings, said inner casing interiorly defining an open-ended inner compartment and cooperating with said outer casing and said endwalls to define an endwalled annular outer compartment in surrounding relationship with said inner compartment, said endwalls also respectively defining mutually aligned marginal apertures receiving said frame members therethrough, and wherein said outer compartment contains said preselected substance therewithin.

12. A system as defined in claim 11, wherein one each of said explosive charges is disposed within the inner chamber of one each of said canisters.

13. A system as defined in claim 12, wherein said aft mounting hub and said partitions respectively define a central bore registering in coaxial alignment with the inner chamber of each of said canisters, and wherein said detonating means comprises a series of time-delay fuses individually mounted in the central bore of said aft mounting hub and each of said partitions, and one each of said explosive charges being operatively associated with and detonable by one each said time-delay fuses.

14. A system as defined in claim 13, wherein the time-delay fuse mounted in the aft mounting hub is adapted to be initially activated by the means for launching or propelling said system, and wherein each other time-delay fuse is adapted to be individually activated in response to detonation of the next rearwardly adjacent explosive charge.

15. A system as defined in claim 12, including an expandable insulator projecting into the inner chamber of each respective canister and covering the explosive charge therewithin.

16. A system as defined in claim 15, wherein said expandable insulator is in the form of a rubber tube.

17. A system as defined in claim 16, wherein said launching or propelling means is a rocket motor.

18. A system as defined in any one of claims 7, 8, 9, 10, 11, 12, 13, 14, 15, 16 or 17, wherein said system is adapted for use as a deception system for impeding locational detection of flying aircraft, and wherein said canisters respectively contain a quantity of decoy material packaged therewithin.

* * * * *